US007666015B2

(12) United States Patent
Sakamoto et al.

(10) Patent No.: US 7,666,015 B2
(45) Date of Patent: Feb. 23, 2010

(54) BOARD-CONNECTING CONNECTOR

(75) Inventors: Nobuyuki Sakamoto, Makinohara (JP); Keiko Azuma, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/155,549

(22) Filed: Jun. 5, 2008

(65) Prior Publication Data

US 2009/0004889 A1 Jan. 1, 2009

(30) Foreign Application Priority Data

Jun. 6, 2007 (JP) ..... 2007-149893

(51) Int. Cl.
*H01R 13/62* (2006.01)

(52) U.S. Cl. ..... 439/260

(58) Field of Classification Search ..... 439/260, 439/630, 159, 946, 633
See application file for complete search history.

(56) References Cited

U.S. PATENT DOCUMENTS 6,865,329 B2 * 3/2005 Fujiwara et al. ..... 385/134
7,214,099 B2 * 5/2007 Kikuchi et al. ..... 439/630

FOREIGN PATENT DOCUMENTS

| | | |
|---|---|---|
| JP | 08-037065 | 2/1996 |
| JP | 08-69836 | 3/1996 |
| JP | 08-236200 | 9/1996 |

* cited by examiner

*Primary Examiner*—Jean F Duverne
(74) *Attorney, Agent, or Firm*—Edwards Angell Palmer & Dodge LLP

(57) ABSTRACT

A board-connecting connector including a pair of inner housings opposed to each other for receiving elastic contact terminals with respect to a circuit board, a guiding plate having a sloped guiding part for engaging inner housing-driven projections and guiding the inner housings close to each other, and an outer housing for receiving the inner housings and the guide plate, and holding the guide plate. When the circuit board is fully inserted into the pair of inner housings, the circuit board abuts on the inner housings, and pushes to move the inner housings along the guiding plate.

13 Claims, 14 Drawing Sheets

BOARD-CONNECTING CONNECTOR

CROSS REFERENCE TO RELATED APPLICATIONS

This application is on the basis of Japanese Patent Application No. 2007-149893, the contents of which are hereby incorporated by reference.

BACKGROUND OF THE INVENTION

1. Field of the Invention

The present invention relates to a board-connecting connector to allow a print circuit board to be inserted into a pair of elastic contact terminals with a low insertion force for connecting to the board-connecting connector.

2. Description of the Related Art

FIG. 21 shows a first embodiment of a conventional board-connecting connector (see Patent Document 1).

This board-connecting connector 71 is also referred to as a card edge connector. The card edge connector 71 includes: one connector 74 in which a card edge, namely, an end of a print circuit board 72 is projected into an interior of a connector fitting chamber of a connector housing 73; and the other connector 78 having a pair of elastic contact terminals 75 for holding the print circuit board 72 in a board thickness direction, a pair of inner housings 76 for receiving the elastic contact terminals 75, and an outer housing 77 for receiving the inner housings 76.

A pair of upper and lower slope walls 79 are formed on a rear side of an inside of the connector housing 73. A spring 80 pushes top ends of the inner housings 76 in an opening direction. When the connectors 74, 78 are connected to each other, the top ends of the inner housings 76 are closed while sliding on the slope walls 79. Thus, inner elastic contact terminals 75 contact terminal parts of the print circuit board 72. Because a pair of inner housings 76 are open at a beginning of a connection of the connector 71, the connection is carried out with a low connection force.

FIG. 22 shows a second embodiment of the conventional board-connecting connector (see Patent Document 2).

This board-connecting connector 81 includes: a coil spring 84 connected to an outer terminal 83 at an inside of a connector housing 82 made of insulating synthetic resin; a toggle switch 85 pushed forward by the coil spring 84; and a pair of upper and lower elastic contact terminals 86 fixed to conducting parts of the toggle switch 85, projected outward when the connector 81 is not connected, and received in the connector housing 82 when the connector 81 is connected.

When the end of a circuit board 87 is inserted into an interior of the connector housing 82, the circuit board 87 pushes the toggle switch 85. Then, the toggle switch 85 and the elastic contact terminals 86 are moved backward, and then the pair of elastic contact terminals 86 hold the circuit board 87 in the connector housing 82. Because the elastic contact terminals 86 are open at the beginning of the insertion of the circuit board 87, the circuit board 87 is inserted with low insertion force.

For locking the circuit board 87 on the board-connecting connector 81, it is disclosed that holes (not shown) are formed on the circuit board 87, and projections (not shown) for engaging with the holes are formed at top ends of the pair of elastic contact terminals 86.

FIG. 23 shows a third embodiment of the conventional board-connecting connector (see Patent Document 3).

This board-connecting connector 88 includes: a connector housing 91 having a slit 90 into which an end of a circuit board 89 is inserted; and a lever 92 rotatably mounted on the connector housing 91 for fixing and releasing the circuit board 89.

After the circuit board 89 is inserted into the wide slit 90 with a low insertion force and freely fitted into the connector housing 91, the lever 92 is rotated inward to make a wedge board 92*a* push and hold the circuit board 89 toward an inner wall of the connector housing 91, and to engage a hole 93 of the circuit board 89 with a projection 94 of the connector housing 91. When the lever is rotated outward, a pushing board 92*b* of the lever 92 pushes the circuit board 89 in a releasing direction.

[Patent Document 1] Japanese Published Patent Application No. H8-37065 (FIGS. 2 to 4)

[Patent Document 2] Japanese Published Patent Application No. H8-236200 (FIG. 1 (a), (b))

[Patent Document 3] Japanese Published Patent Application No. H8-69836 (FIGS. 5 and 6)

However, in the first conventional embodiment (FIG. 21), the print circuit board 72 is inserted with low insertion force at the beginning of the connection, but at the end of the connection, the top end of the inner housings 76 frictionally slides on the slope walls 79 of the mating connector housing 73. Therefore, there is a problem that the insertion force may be increased due to the friction.

Further, in the second conventional embodiment (FIG. 22), only bending force of the elastic contact terminals 86 holds the circuit board 87. Therefore, when a thickness of the circuit board 87 is changed, the bending force is changed. Therefore, there is a problem that the board-connecting connector 81 is not adapted to the circuit boards 87 having various thicknesses. Further, when the circuit board 87 becomes thin after connection as a result of heat or the like, the bending force is changed and the circuit board 87 may not be sufficiently held.

Further, in the second conventional embodiment (FIG. 22), if lengths of the elastic contact terminals 86 are varied when the circuit board 87 is locked on the elastic contact terminals 86, the projection (not shown) at the top end of the elastic contact terminals 86 is not engaged with the hole (not shown) of the circuit board 87. Therefore there is a problem that the circuit board 87 may not be locked on the elastic contact terminals 86.

Further, in the third conventional embodiment (FIG. 23), because an inner width of the slit 90 of the connector housing 91 is predetermined, the locking projection 94 may be caught by the top end of the circuit board 89. Therefore, there is a problem that the circuit board 89 may not be smoothly inserted. Further, if the projection 94 is not bent, the projection 94 may not be engaged with the hole 93. For avoiding this problem, overlapping depth between the projection 94 and the hole 93 becomes small. Therefore, there is a problem that the locking force may be reduced.

Accordingly, an object of the present invention is to provide a board-connecting connector which allows a circuit board to be inserted thereinto with low insertion force from the beginning to the end of the insertion, allows a good contact pressure even when a thickness of the circuit board is varied, and allows the circuit board to be securely locked.

SUMMARY OF THE INVENTION

In order to attain the object, according to the present invention, there is provided a board-connecting connector including:

a pair of inner housings opposed to each other for receiving elastic contact terminals with respect to a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate.

According to the above structure, a pair of inner housings and the guiding plates are inserted into an interior of the outer housing while the pair of inner housings are separated from each other in a width larger than a thickness of the circuit board. In this state, the circuit board is inserted into a gap between the pair of inner housings with low insertion force without any interruption until the circuit board abuts on abutting parts of the inner housings. Next, the circuit board pushes the inner housings in an insertion direction to move the inner housings to a direction close to each other along the sloped guiding part of the guide plate, and elastic contact terminals disposed inside the inner housings elastically contact terminals of the circuit board.

Preferably, the inner housing-driven projection of one inner housing is engaged with a straight guiding part of the guiding plate in the insertion direction of the circuit board, and the inner housing-driven projection of the other inner housing is engaged with the sloped guiding part of the guiding plate.

According to the above structure, the one inner housing is moved parallel to the insertion direction of the circuit board, and the other inner housing is moved both in the insertion direction and a thickness direction of the circuit board to be moved close to the one inner housing.

Preferably, the board-connecting connector further includes an elastic member for pushing the guiding plate in a direction opposed to the insertion direction of the circuit board in the outer housing.

According to the above structure, after the circuit board is inserted into between the inner housings and abuts on the inner housings, the circuit board and the inner housings are pushed into the outer housing against pushing force of the elastic member (while compressing the elastic member). Thus, the guiding plate makes the inner housings close to each other to make the elastic contact terminals elastically contact the circuit board.

Preferably, the elastic member absorbs variation in the thickness of the circuit board.

According to the above structure, when the circuit board is thick, a compression stroke of the elastic member is small, and when the circuit board is thin, a compression stroke of the elastic member is large. Thus, even when the thickness of the circuit board is varied, the circuit board contacts the elastic contact terminals with good contact pressure.

Preferably, as the pair of inner housings are close to each other in the thickness direction of the circuit board, the pair of inner housings are positioned by an engagement between a convex part and a concave part thereof.

According to the above structure, as the inner housings are moved close to each other due to the guiding plate, the convex part of the one inner housing is slidingly engaged with the convex part of the other inner housing in a closing direction of the inner housings. Thus, the inner housings are positioned, and are locked together in the insertion direction of the circuit board.

Preferably, as the circuit board and at least one of the inner housings are moved close to each other in the thickness direction of the circuit board, the circuit board and at least one of the inner housings are locked together with an engagement of a convex part and a concave part thereof.

According to the above structure, when the inner housings are moved close to the circuit board in the thickness direction of the circuit board, for example, a convex part of the one inner housing is moved into and engaged with a concave part of the circuit board. Thus, the circuit board is prevented from falling out of the inner housings and locked on the one inner housing.

Preferably, the inner housing and a locking arm of the outer housing are locked together with an engagement of a convex part and a concave part thereof.

According to the above structure, when the inner housings are moved close to each other in a holding direction of the circuit board, and are fitted into the outer housing, at the same time, for example, a convex part of the one inner housing is engaged with a concave of the outer housing. Thus, the inner housings and the outer housing are firmly locked together.

Preferably, while the pair of inner housings is inserted into the outer housing, a terminal is inserted from a position opposed to the circuit board and is connected to the elastic contact terminal.

According to the above structure, using an existing process of inserting a terminal into the connector housing, the terminal is inserted into the inner housing in the outer housing from a rear opening. Preferably, an electric wire is connected to the terminal.

These and other objects, features, and advantages of the present invention will become more apparent upon reading of the following detailed description along with the accompanied drawings.

DETAILED DESCRIPTION OF THE PREFERRED EMBODIMENTS

Figure 1:
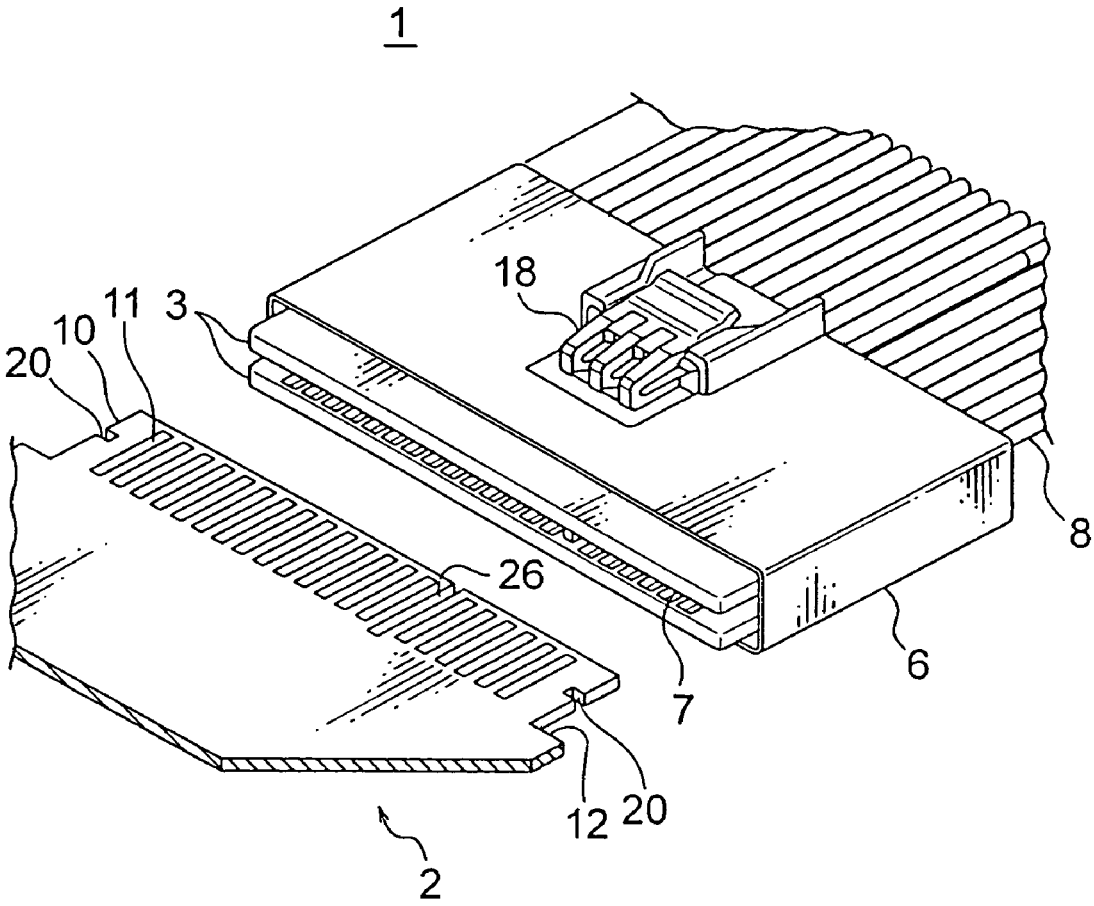
FIG. 1 is a perspective view showing an embodiment of a board-connecting connector according to the present invention.
Figure 2:
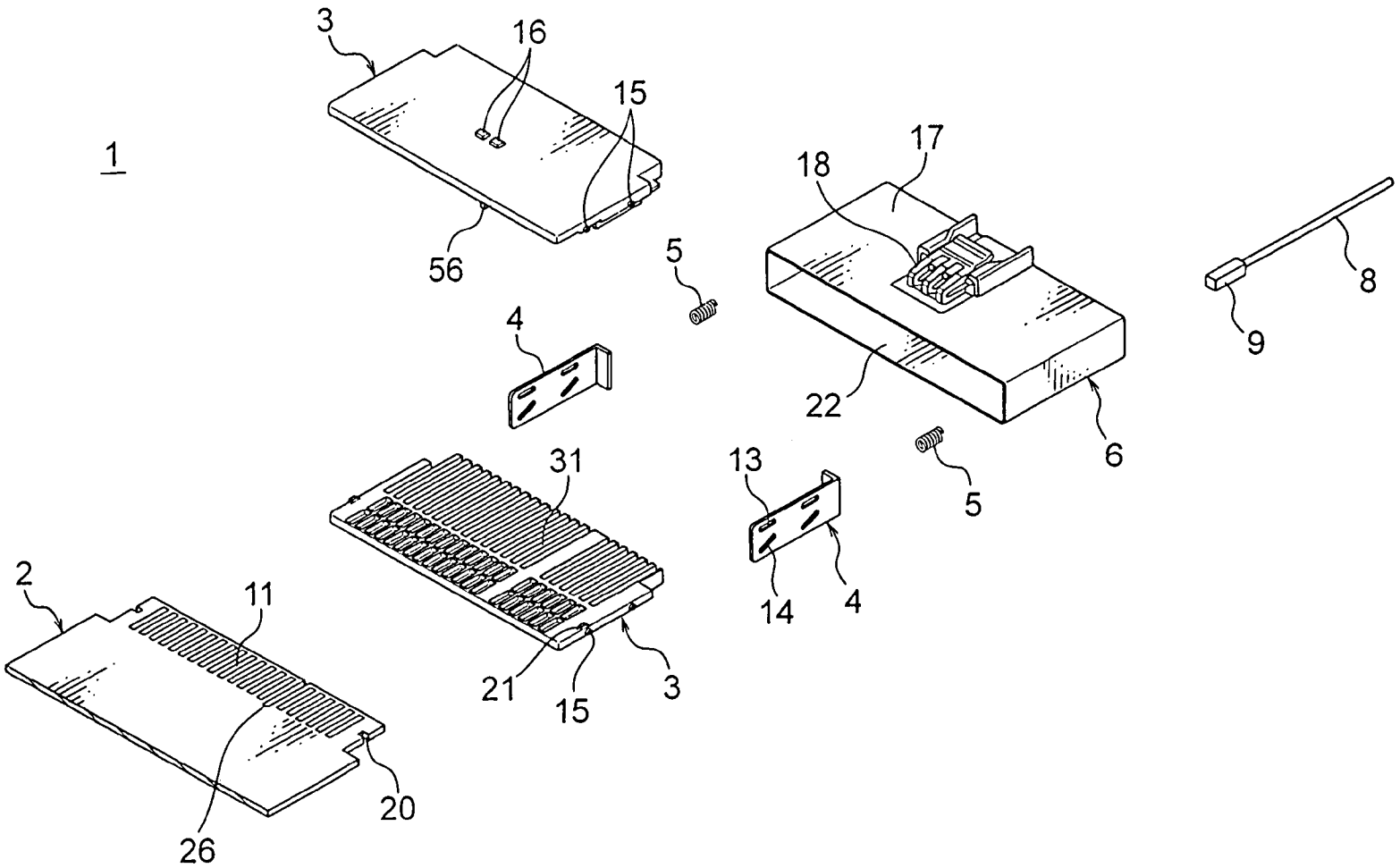
FIG. 2 is an exploded sectional view showing the board-connecting connector according to the present invention.

FIGS. 1 and 2 show a whole structure of an embodiment of a board-connecting connector according to the present invention.

This board-connecting connector 1 includes: a pair of upper and lower inner housings 3 made of insulating synthetic resin between which a circuit board 2 is inserted into; a pair of guiding plates 4 (FIG. 2) to be respectively engaged with of the pair of inner housings at left and right sides; a pair of compression coil springs 5 to push the guiding plates 4 toward the circuit board 2 (forward); a boxy outer housing 6 made of insulating synthetic resin for receiving the inner housings 3, the guiding plates 4, and the compression coil springs 5 (elastic member); elastic contact terminals 7 (FIG. 3) respectively attached to insides of the inner housings 3 and arranged parallel to each other; and female terminals 9 (terminal) each having an electric wire 8 to be respectively connected to the elastic contact terminals 7.

Terminal parts 11 of a printed circuit are arranged parallel to each other in the same pitch on both front and back (upper and lower) surfaces at a tip 10 (top end) of the circuit board 2. The tip 10 is extended backward to a rear side of the circuit board 2 via a step 12.

Each guiding plate 4 has a pair of front and rear long guiding holes 13, 14 (guiding part). Each inner housing 3 has a pair of front and rear short cylindrical projections 15 (inner housing-driven projection) at both sides thereof to be engaged with the guiding holes 13, 14. An upper pair of the guiding holes 13 are formed horizontal (straight), and a lower pair of the guiding holes 14 are formed obliquely.

Figure 3:
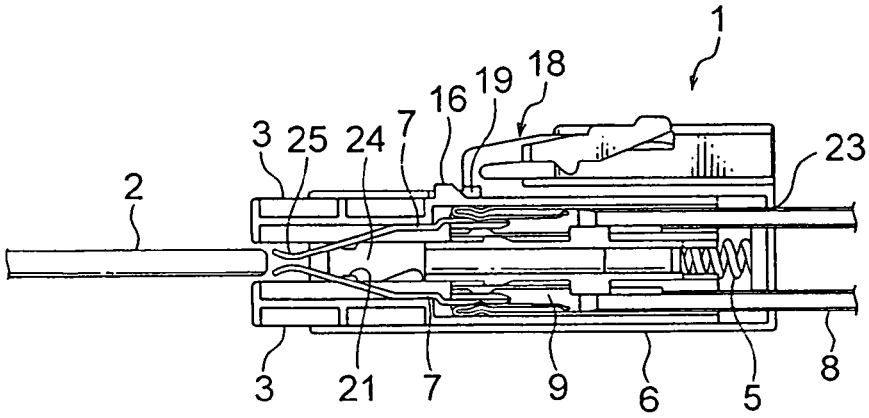
FIG. 3 is a vertical sectional view showing the board-connecting connector before a circuit board is inserted thereinto.
Figure 14:
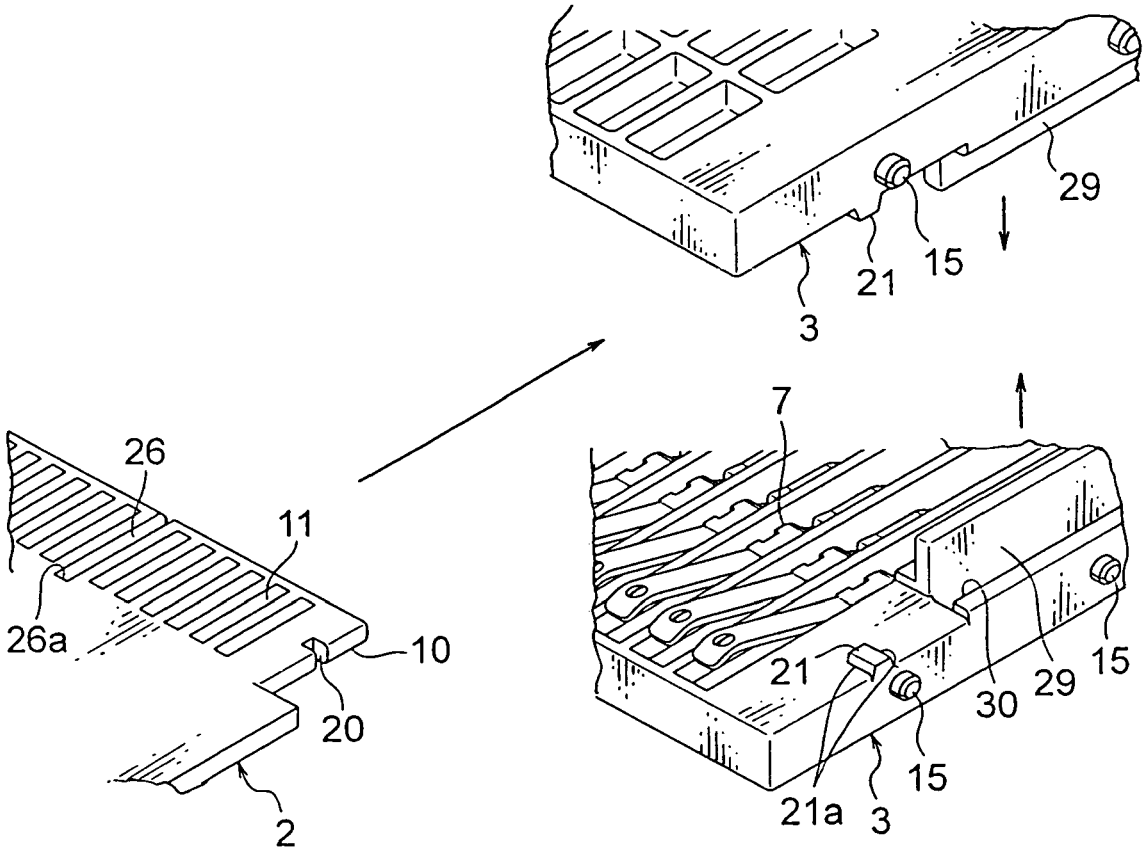
FIG. 14 is an exploded perspective view showing a locking structure of the circuit board and the inner housings.

A locking projection 16 (convex) is formed on an outer wall (upper wall) of the upper inner housing. When the projection 16 is engaged with a rear wall 19 (concave) of an elastic locking arm 18 on the upper wall 17 of the outer housing 6 (FIG. 3), the inner housing 3 is locked on the outer housing 6. Vertical grooves 20 (concave) are formed at left and right edge of the circuit board 2. The grooves 20 are locked on projections 21 (convex) of the upper and lower inner housings 3 (FIG. 14). The outer housing 6 includes a front rectangular opening 22 and a rear opening 23 for inserting the terminals (FIG. 3). A slit 26 extended in an insertion direction of the circuit board 2 is formed at the middle in a width direction of the circuit board 2. a convex 56 to be engaged with the slit 26 for positioning the circuit board 2 is formed on an inner wall of the upper inner housing 3.

FIGS. 3 to 7 show sequential operation of connecting the circuit board 2 to the board-connecting connector 1.

FIG. 3 shows a state just before the tip of the circuit board 2 is inserted into between the pair of upper and lower elastic contact terminals 7 of the board-connecting connector 1. A gap 24 wider than a thickness of the circuit board 2 is formed between the upper and lower inner housings 3. Upper and lower curving parts 25 (contact points) are positioned close to each other in the gap 24. The inner housings 3 are projected forward from the outer housing 6. The locking projection 16 on the upper inner housing 3 is disposed at a front side of a horizontal step 19 of the locking arm 18 of the outer housing 6. Locking projections 21 for the circuit board 2 are formed on inner walls of the upper and lower inner housings 3.

Figure 4:
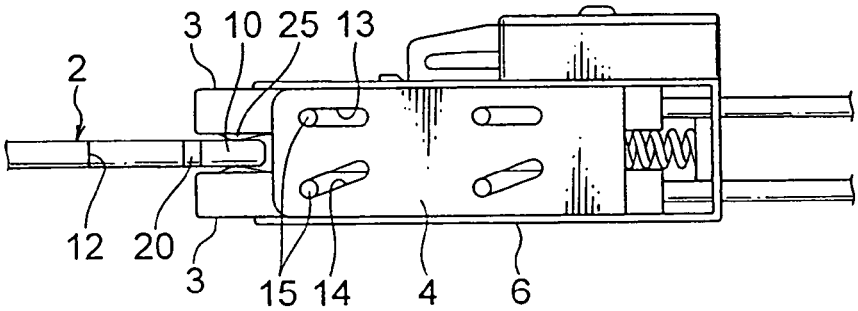
FIG. 4 is a vertical sectional view showing the board-connecting connector at a beginning of inserting the circuit board thereinto.

FIG. 4 shows a state that the circuit board 2 is initially inserted into between the upper and lower elastic contact terminals 7. The tip 10 of the circuit board 2 is inserted along curving walls 25 at front ends of the elastic contact terminals 7 with a low insertion force. Both left and right guiding plates 4 are positioned at the middle of the outer housing 6. The upper and lower inner housings 3 are positioned at the same position as FIG. 3. The projections 15 of the inner housings 3 are positioned at front ends of the guiding holes 13, 14 of the guiding plates 4.

When the board-connecting connector 1 is assembled, while the projections are inserted into the guiding holes 13, 14, the inner housings 3 are inserted into the outer housing integrally with the guiding plates 4. In FIG. 4, the vertical groove 20 of the circuit board 2 is to be engaged with the locking projection 21 (FIG. 3). A step 12 is formed on the vertical groove 20. In FIGS. 3 and 4, the positions of the inner housings 3 and the guiding plates 4 are the same.

Figure 5:
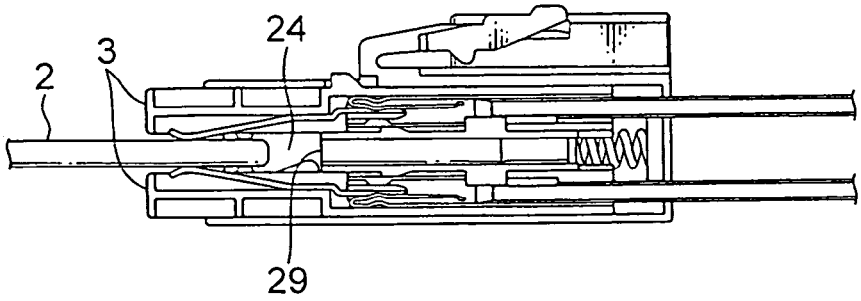
FIG. 5 is a vertical sectional view showing the board-connecting connector in the middle of inserting the circuit board thereinto.

FIG. 5 shows a state that the circuit board 2 is further inserted into between the inner housings 3. The positions of the inner housings 3 and the guiding plates 4 are not changed until the circuit board 2 is inserted into a rear side of the gap 24 of the inner housings 3 to abut on an abutting part 29 at the substantially center of the inner housings 3. The insertion force of the circuit board 2 is low from the initial insertion to this position. In FIGS. 3 to 5, the positions of the inner housings 3 and the guiding plates 4 are the same.

Figure 6A:
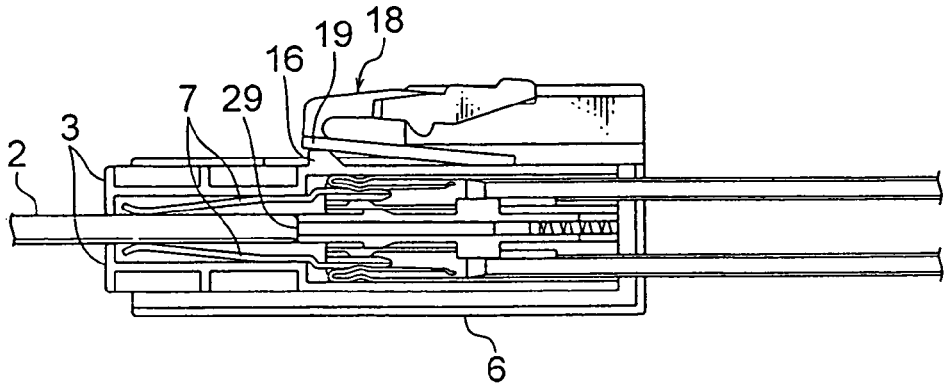
FIG. 6A is a vertical sectional view showing a center part of the board-connecting connector when the circuit board is fully inserted into the board-connecting connector.
Figure 6B:
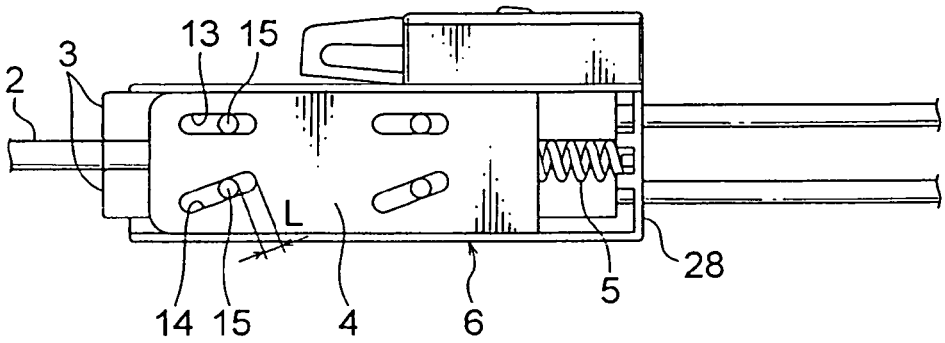
FIG. 6B is a vertical sectional view showing a side part of the board-connecting connector when the circuit board is fully inserted into the board-connecting connector.

FIGS. 6A and 6B show a state that when the tip of the circuit board 2 is inserted into the rear side of the gap 24 of the inner housings 3 and abuts on the abutting part 29 of the inner housing 3, the upper and lower inner housings 3 are pushed backward and the lower inner housing 3 is moved close to the upper inner housing 3 along the guiding holes 13, 14 of the guiding plates 4.

As shown in FIG. 6B, in the upper guiding hole 13, the upper projection 15 is moved horizontally to a position just before the rear end of the guiding hole 13. In the lower guiding hole 14, the lower projection 15 is moved obliquely to a position just before the rear end of the guiding hole 14. Both projections 15 are stopped with a little length L from the rear ends of the guiding holes 13, 15.

As shown in FIG. 6A, the step wall 19 of the locking arm 18 of the outer housing 6 is moved on the locking projection 16 of the upper inner housing 3. The inner housing is not fully inserted into a rear end of the outer housing 6. When the lower inner housing 3 is moved upward, the gap between the upper and lower elastic contact terminals is reduced, and both elastic contact terminals abut on the circuit board 2 with a normal amount of displacement (contact pressure). As shown in FIG. 5, the circuit board 2 is inserted into the inner housings 3 with a low insertion force, then, as shown in FIG. 6, the elastic contact terminals 7 elastically contact the circuit board 2 with a normal pressure.

Figure 7:
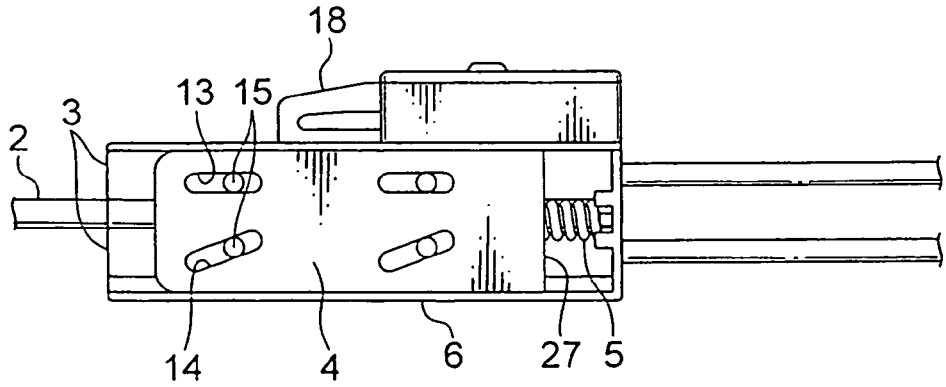
FIG. 7 is a vertical sectional view showing a state that an inner housing is fully fitted into an outer housing.

FIG. 7 shows a state that the circuit board 2 is further pushed in the insertion direction, and is fully fitted into the outer housing 6 integrally with the inner housings 3. In FIG. 7, the locking projection 16 of FIG. 16A is moved over the step wall 19 (FIG. 6A) of the locking arm 18, and engaged with a rear side of the step wall 19. Because the lower and upper inner housings are connected to each other via the guiding plates 4, or, locked with projections (FIG. 8) and grooves 30, a locking projection 16 is unnecessary for the lower inner housing 3.

In FIG. 7, positions of the projections 15 in the guiding holes 13, 14 are the same as those in FIG. 6B. Namely, from a state shown in FIG. 6B, the inner housings 3 and the guiding plates 4 are integrally moved backward, and a flange 27 at the rear end of the guising plates 4 pushes the coil spring 5 to compress the coil springs 5 between the flange 27 and the rear wall 28 of the outer housing, so that the guiding plates 4 are pushed forward by a pushing force of the coil spring 5. This pushing force pushes the lower inner plate 3 upward via the sloped guiding hole 14 to ensure the connection between the elastic contact terminals 7 and the circuit board 2.

In FIG. 7, when lock between the inner housings 3 and the outer housing 6 is released with an operation of the locking arm 18, and the circuit board 2 is pulled out from the outer housing 6, the lower inner housing 3 is moved downward along the sloped guiding hole 14 and separated from the upper inner housing 3 in a thickness direction of the circuit board 2, the contact between the elastic contact terminal 7 and the circuit board 2 is released, and the lock between the inner housing 3 and the circuit board 2 is released. Thus, the circuit board 2 is released smoothly with a low releasing force.

Figure 8:
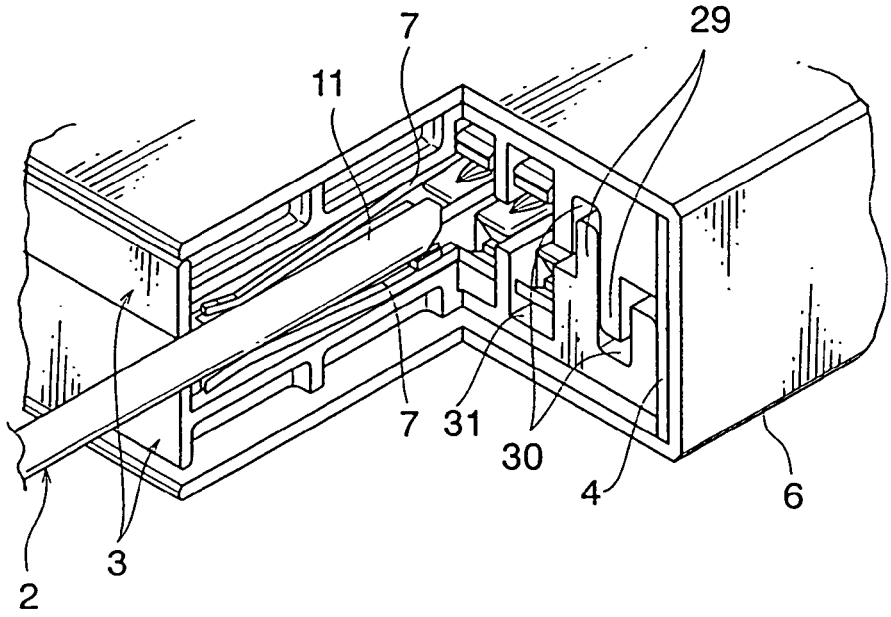
FIG. 8 is a partially sectional perspective view showing a positioning structure of upper and lower inner housings.

FIG. 8 sectionally shows a state that the circuit board 2 is inserted into the board-connecting connector 1.

Figure 9:
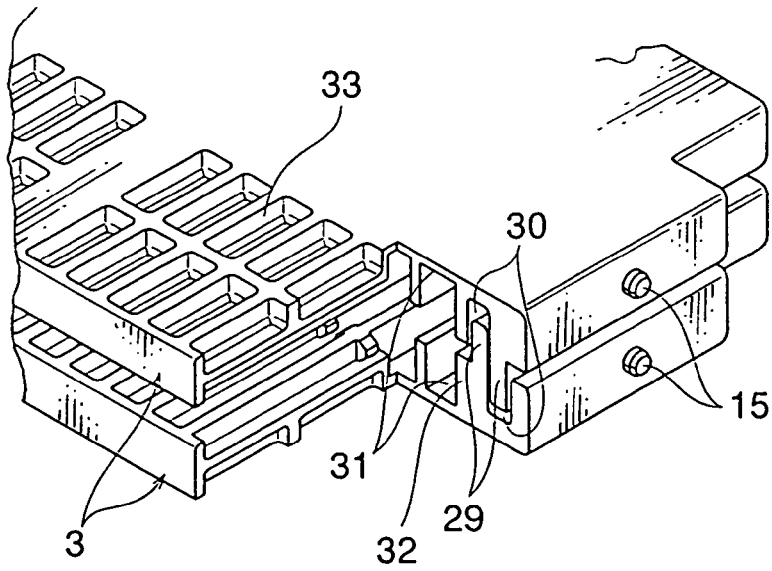
FIG. 9 is a perspective view showing the inner housings engaged with each other.
Figure 10A:
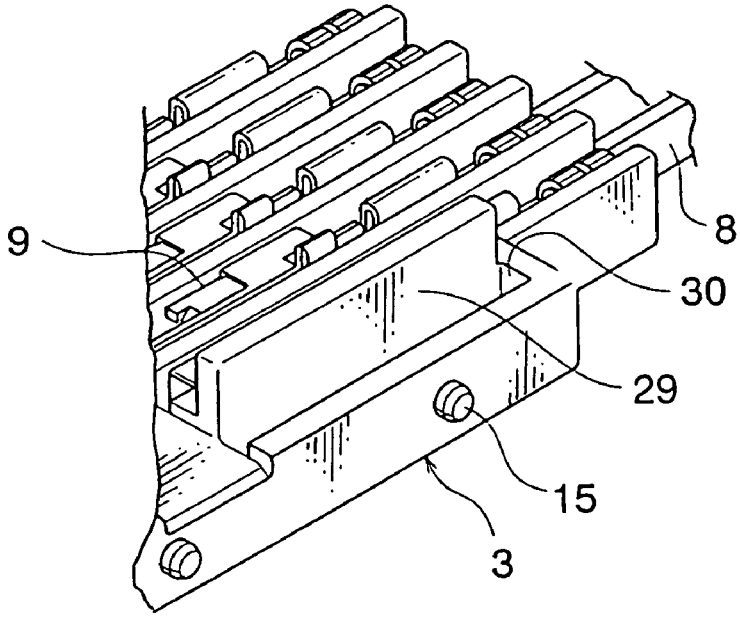
FIG. 10A is a perspective view showing one inner housing.
Figure 10B:
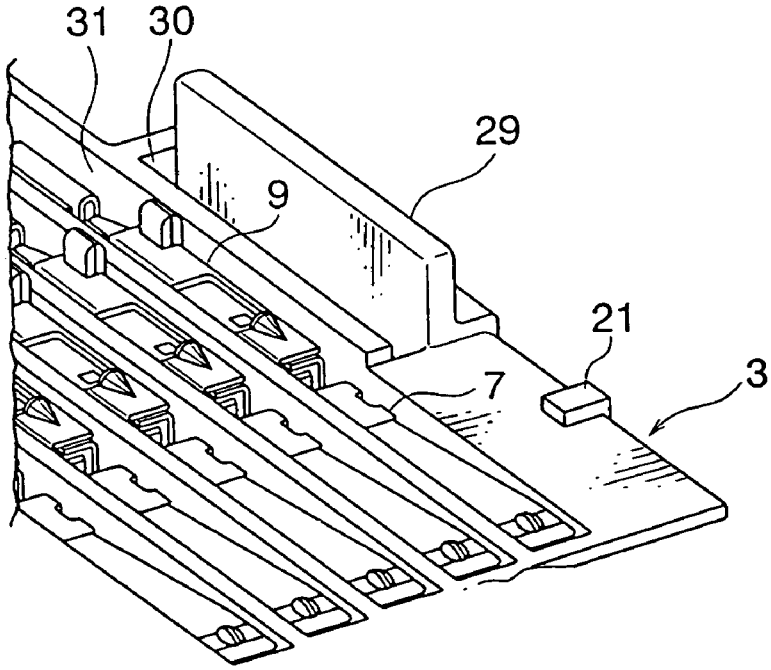
FIG. 10B is a perspective view showing the other inner housing.

As shown in FIGS. 9, 10A, and 10B, a convex board 29 (convex) and a concave groove 30 (concave) slidably engaged with each other are formed on both left and right sides of the upper and lower inner housings 3. In the lower inner housing 3, the convex board 29 is extended from a partition wall 32 of a terminal receiving groove 31. The convex groove 30 is formed outside of the convex board 29. The concave groove 30 in the upper inner housing 30 is opposed to the convex board 29 in the lower inner housing 30. The convex board projected downward is formed outside of the concave groove 30 in the upper inner housing 30.

While the projections 15 on the sidewalls of the upper and lower inner housings 3 are moved backward along the guiding plates 13, 14 of the guiding plates 4 (FIG. 7), when the upper and lower inner housings 3 are moved close to each other, and the upper and lower convex boards 29 are slidably engaged with the upper and lower concave grooves 30, the upper and lower inner housings 3 are positioned to each other, and the upper and lower elastic contact terminals 7 in the upper and lower inner housings 3 elastically contact the terminal parts 11 of the circuit board 2 correctly without any dislocation. When the tip of the circuit board 2 abuts on the front end of the abutting part 29, the upper and lower inner housings 3 are moved backward along the guiding plates 4 elastically supported by the outer housing 6.

In FIGS. 8 to 10, the elastic contact terminals 7 are attached to the terminal receiving grooves 31. Female terminals 9 are connected to the elastic contact terminals 7. The inner housing-driven projections 15 are engaged with the guiding holes 13, 14. The concave grooves 33 are formed on the upper wall of the upper inner housing 3. The upper and lower projections 15 are vertically opposed to each other.

Figure 21:
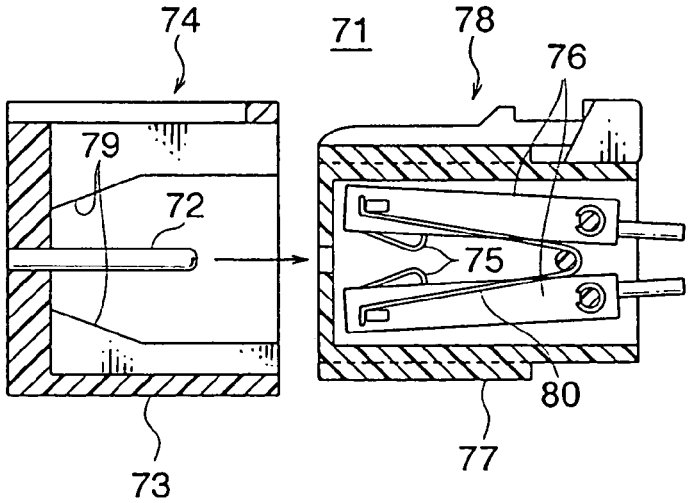
FIG. 21 PRIOR ART
FIG. 21 is a vertical sectional view showing a first embodiment of a conventional board-connecting connector.

The structure shown in FIGS. 1 to 10 corresponds to a solution of problems the conventional embodiment shown in FIG. 21 has.

FIGS. 11A, 11B, 12A and 12B show a state that the coil spring 5 is deformed corresponding to a thickness of the circuit board 2 to absorb the thickness difference and to allow the elastic contact terminals 7 to contact the circuit board 2 with a good contact pressure.

Figure 11A:
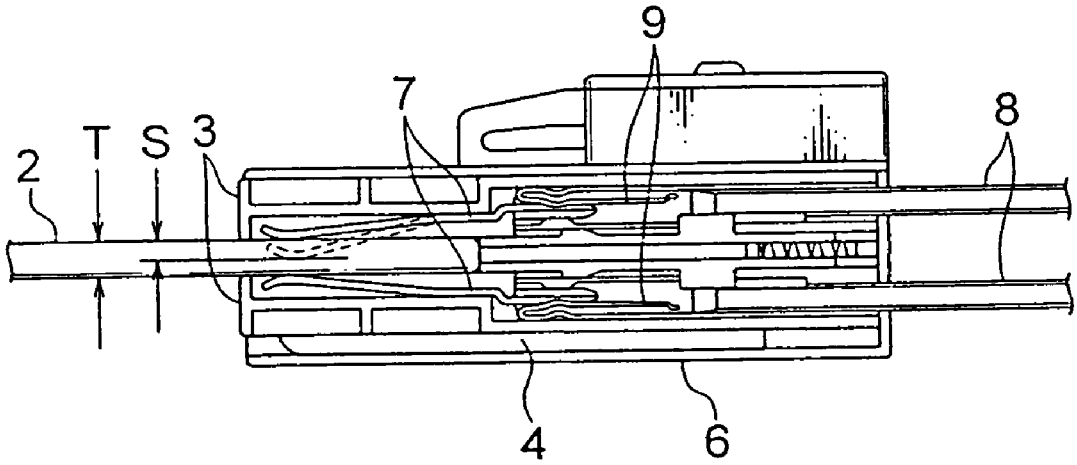
FIG. 11A is a vertical sectional view showing a center part of the board-connecting connector connected to a thin circuit board.
Figure 11B:
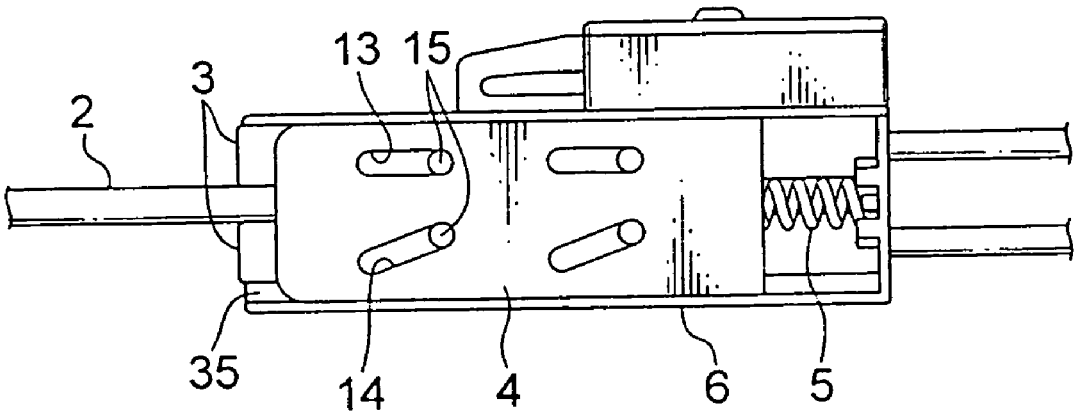
FIG. 11B is a vertical sectional view showing a side part of the connected to a thin circuit board.

Namely, as shown in FIGS. 11A and 11B, in a case using a thin circuit board 2', when the inner housing 3 is fully inserted into the outer housing 6, the amount of compression of the coil spring 5 (backward stroke of the guiding plate 4) is small, and the projections 15 of the inner housings 3 are moved to the rear ends of the guiding holes 13, 14. For example, a thickness T of the circuit board 2 is 1.2 mm, a deformation length S shown by a chain line in FIG. 11A is 0.8 mm.

Figure 12A:
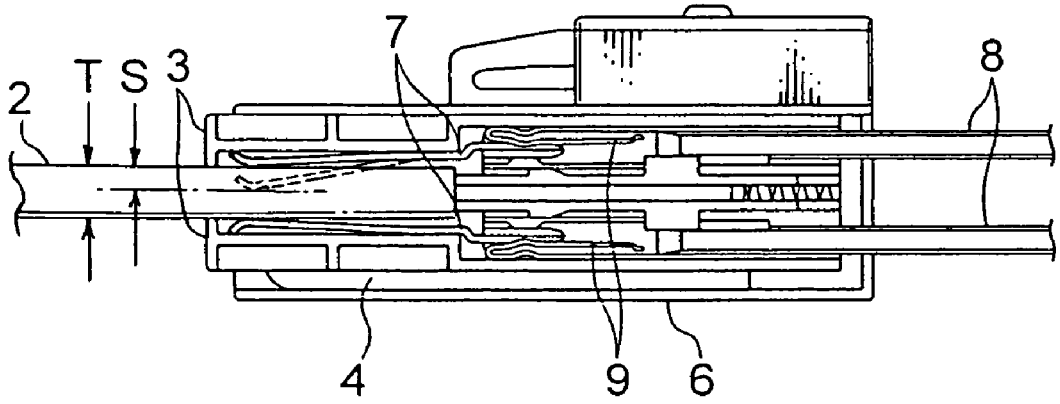
FIG. 12A is a vertical sectional view showing a center part of the board-connecting connector connected to a thick circuit board.
Figure 12B:
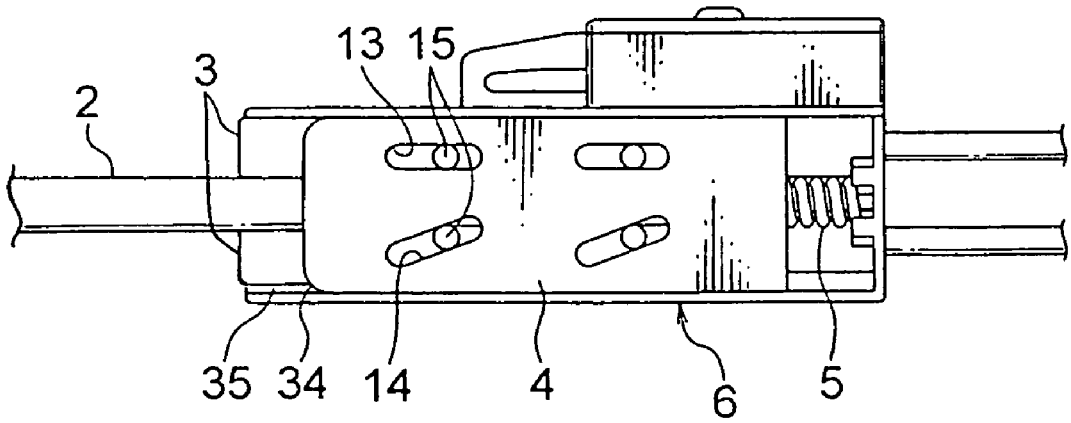
FIG. 12B is a vertical sectional view showing a side part of the board-connecting connector connected to a thick circuit board.

As shown in FIGS. 12A and 12B, in a case using a thick circuit board 2, when the inner housing 3 is fully inserted into the outer housing 6, the amount of compression of the coil spring 5 (backward stroke of the guiding plate 4) is large, and the projections 15 of the inner housings 3 are moved to positions just before the rear ends of the guiding holes 13, 14. For example, the thickness T of the circuit board 2 is 1.6 mm, the deformation length S shown by a chain line in FIG. 12A is 0.8 mm and is the same as FIG. 11A. A gap 35 between the lower inner housing 3 and the lower wall 34 of the outer housing 6 of FIG. 12B is smaller than that of FIG. 11B.

Thus, even when the thickness of the circuit board 2 is varied, owing to the function of the guiding plates 4, the deformation length S is constant, and the same contact force is acted on the circuit board 2. Accordingly, even when the thickness of the circuit board 2 is varied, the same board-connecting connector 1 can be used. Therefore, production cost and management cost are reduced. Further, even when the thickness of the circuit board 2 is reduced due to the thermal effect with age, the guiding plate is moved forward due to the pushing force of the coil spring 5, and the lower inner housing is moved upward so that the contact pressure of the elastic contact terminal 7 is maintained. Therefore, electric contact reliability is increased.

As shown in FIG. 11A, the electric wire 8 is connected to a female terminal 9, and the elastic contact terminal 7 is inserted and connected to the female terminal 9.

Figure 13A:
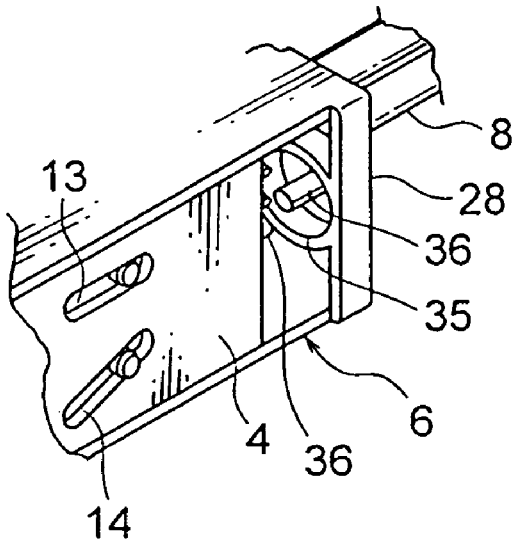
FIG. 13A is a perspective view showing a state that no coil spring for pushing a guiding plate is available.
Figure 13B:
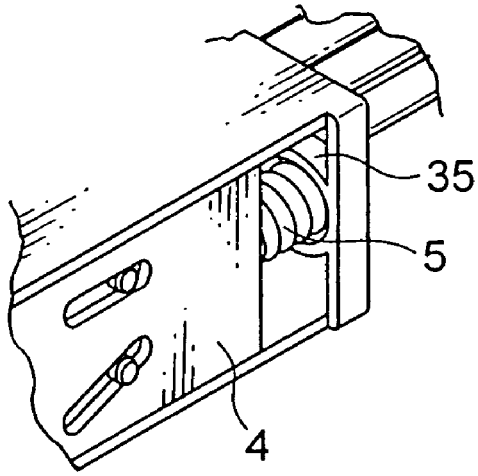
FIG. 13B is a perspective view showing a state that a coil spring is attached.
Figure 13C:
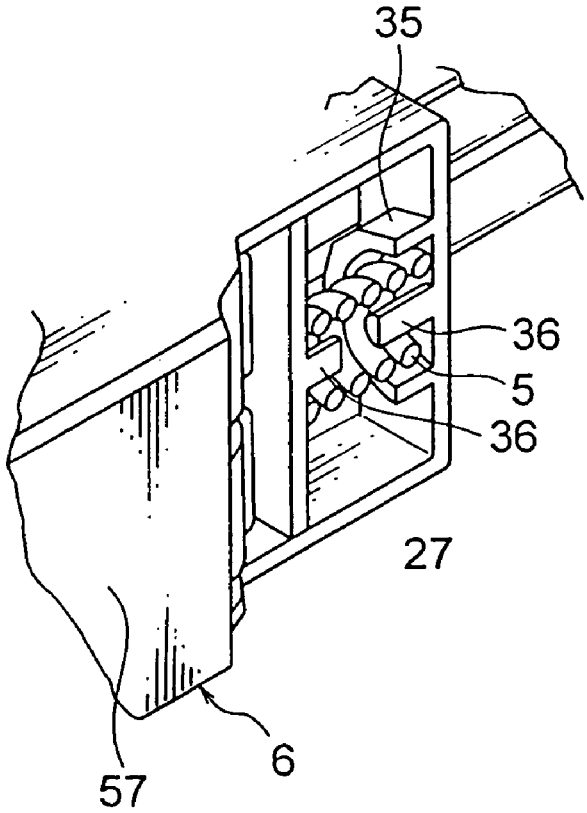
FIG. 13C is a partial sectional perspective view showing the coil spring.

FIGS. 13A to 13C show an embodiment of an attaching structure of the coil spring 5 for pressing the guiding plate 4 in a direction opposed to the insertion direction.

Figure 22:
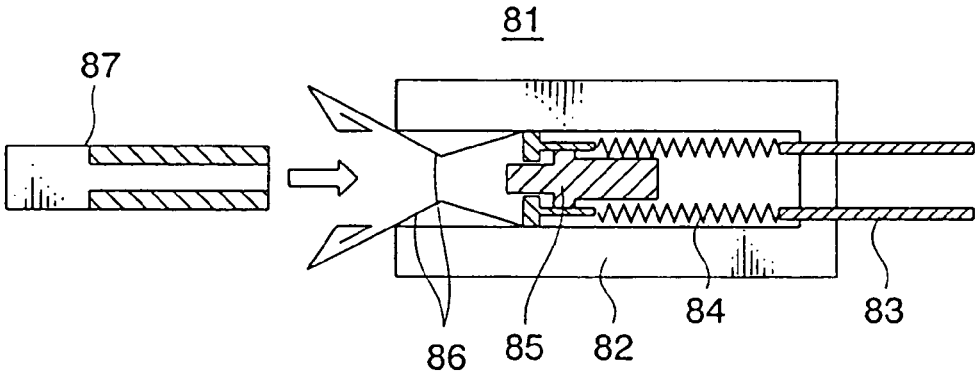
FIG. 22 PRIOR ART
FIG. 22 is a vertical sectional view showing a second embodiment of the conventional board-connecting connector.

In FIG. 13A, the board-connecting connector 1 has no coil spring 5. A circular seat 35 is formed on the vertical rear wall 28 of the outer housing 6. A support pin 36 is projected from the center of the seat 35. Similar support pin 36 is formed on the flange 27 at the rear side of the guising plate 4. In FIG. I 3B, the coil spring 5 is attached to the board-connecting connector 1. FIG. 13C is a partial sectional perspective view showing the coil spring 5 and the seat 35. The structure shown in FIGS. 11A to 13C works for solving the problem of the conventional embodiment shown in FIG. 22.

Figure 15:
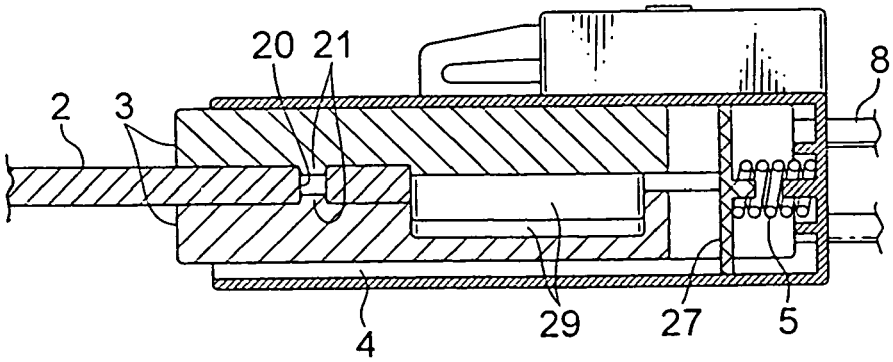
FIG. 15 is a vertical sectional view showing the locking structure of the circuit board and the inner housings.

FIGS. 14 and 15 show an embodiment of a locking structure between the circuit board 2 and the inner housings 3.

As shown in FIG. 14, projections 12 facing each other are respectively formed on the lower side walls (inner wall) of both sides of the front end of the upper inner housing 3 and on the upper side walls (inner wall) of both sides of the front end of the lower inner housing 3. The grooves 20 are penetratedly formed at both sides of the tip 10 of the circuit board 2. Each projection 21 is formed in a trapezoidal shape having tapered walls 21*a* back and forth.

The projections 15 shown in FIG. 14 are engaged with the guiding holes 13, 14. When the convex 56 abuts on the rear end 26*a* of the slit 26, the circuit board 2 is allowed to push the inner housings 3. In this case, the convex 56 works as an abutting part instead of the convex board 29.

As shown in FIG. 15, when the circuit board 2 is fully inserted between the inner housings 3 with the low insertion force, the inner projections 21 of the inner housings 3 are engaged with the grooves 20 at the same time. Thus, the inner housings 3 and the circuit board 2 are firmly locked together. Incidentally, because the inner housings 3 are connected to each other via the guiding plates 4, and are locked together with the convex board 29 (FIG. 8) and the concave groove 30, the circuit board 2 can be locked with any one of the projections on the upper or lower inner housings 3.

In FIG. 15, under the condition that the inner housings 3 is fully inserted into between the inner housings 3, when the electric wire 8 is pulled backward, because the electric wire 8 is connected to the female terminal 9 which is locked in the inner housing 3 (FIG. 11), the inner housing 3 is pushed backward, and the projection 15 of the lower inner housing 3 is pushed upward along the sloped guiding hole 14. Thus, the contact pressure of the elastic contact terminal 7 with respect to the circuit board 2 is properly maintained, and a locking force between the circuit board 2 and the inner housings 3 is increased by holding the circuit board 2 with the inner housings 3. Therefore, the circuit board 2 is surely prevented from falling out of the board-connecting connector 1.

Figure 23:
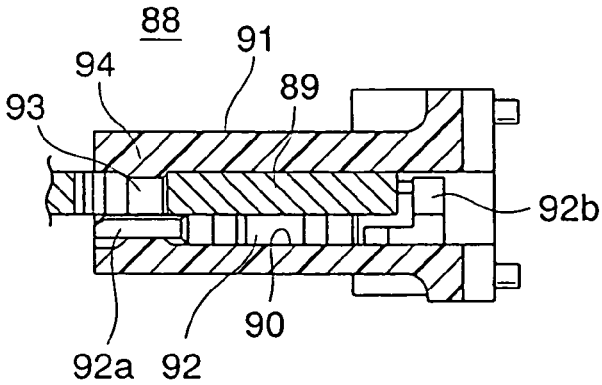
FIG. 23 PRIOR ART
FIG. 23 is a vertical sectional view showing a third embodiment of the conventional board-connecting connector.

When the distance between the upper and lower inner housings 3 is reduced, and the locking projections 21 are inserted into the grooves 20 of the circuit board 2, the locking force between the circuit board 2 and the board-connecting connector 1 is increased. The structure shown in FIGS. 14 to 15 works for solving the problem of the conventional embodiment shown in FIGS. 22 and 23.

Figure 16:
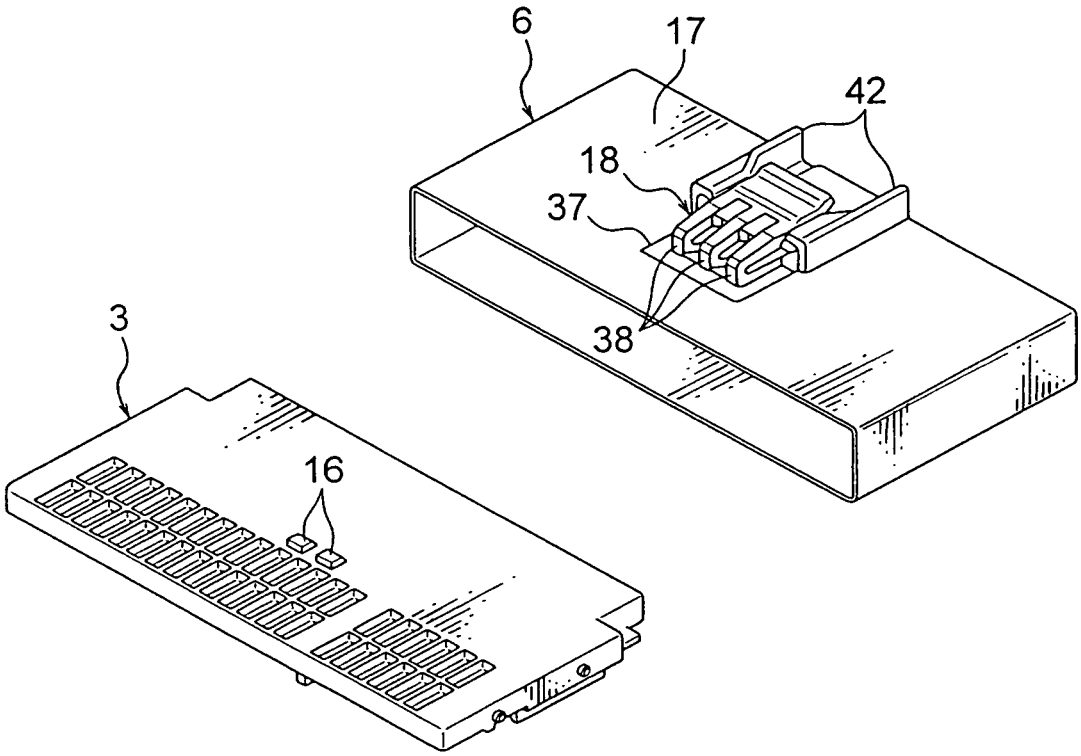
FIG. 16 is an exploded perspective view showing a locking structure of the inner housings and the outer housing.
Figure 17:
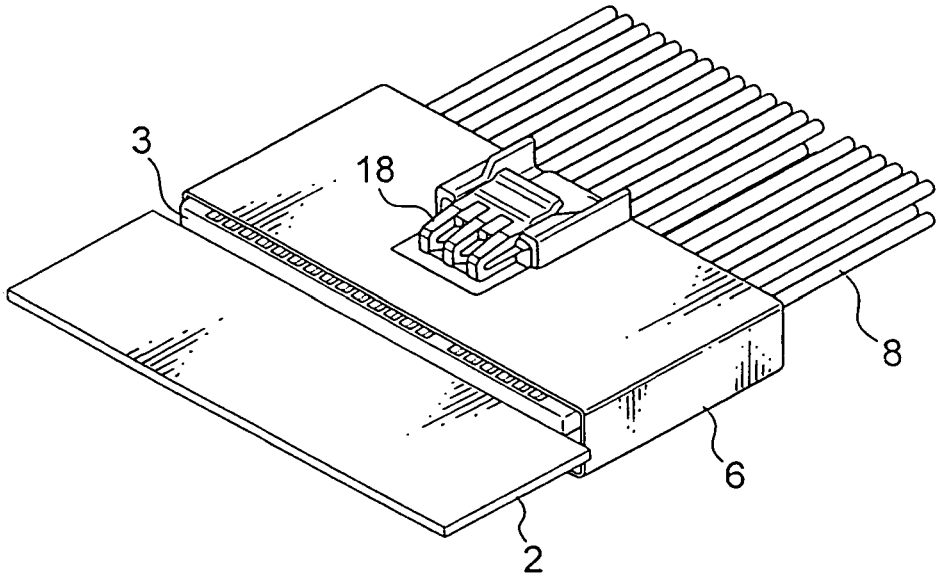
FIG. 17 is a perspective view showing a locking structure of the circuit board, the inner housings, and the outer housing.
Figure 18:
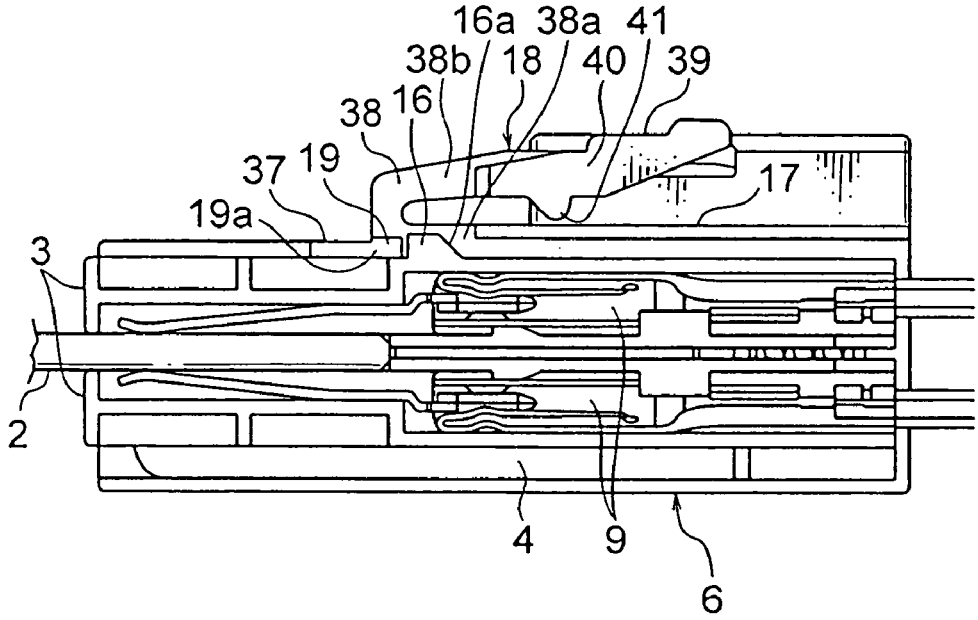
FIG. 18 is a vertical sectional view showing the locking structure of the circuit board, the inner housings, and the outer housing.

FIGS. 16 to 18 show an embodiment of a locking structure between the inner housings 3 (only upper inner housing is shown) and the outer housing 6.

As shown in FIG. 16, a pair of locking projections 16 is formed on a front half of the upper inner housing 3 at the center of a width direction thereof. A locking arm 18 is formed on a rear half of the upper wall 17 of the outer housing 6 at the center of the width direction thereof. A rectangular opening 37 for exposing the pair of locking projections 16 is formed on the upper wall 17 under the locking arm 18. The locking arm 18 has three elastic arm main bodies 38 parallel to each other each having a substantially U shape. As shown in FIG. 18, lower parts at the front ends of the arm main bodies 18 are horizontally connected to each other via the step wall 19, and the locking projection 16 is engaged with a rear side of the step wall 19. Thus, the inner housings 3 are locked on the outer housing 6. Sloped walls 19*a*, 16*a* are formed on the rear ends of the step wall 19 and the locking projection 16. Left and right protecting walls 42 protect the locking arm 18 from external interference.

As shown in FIG. 18, a rear end of a lower part 38*a* of the arm main body 38 is integrally extended to the upper wall 17 via a rear end of the opening 37. A rear end of an upper part 38*b* of the arm main body 38 is integrally extended to a plate-shaped operation part 39. A supporting wall 40 is extended forward from the operation part 39. A supporting projection 41 is formed on a bottom wall of the supporting wall 40. When pushing downward the operation part 39, the supporting projection 41 abuts on the upper wall 17, and the arm main body 38 is lifted up integrally with the step wall 19 about the supporting projection 41. Thus, the lock with the locking projection 16 is released.

As shown in FIGS. 16 to 18, while the inner housings 3 and the circuit board 2 are locked together, when the inner housings 3 and the outer housing 6 are locked together, the circuit board 2 is surely prevented from falling out of the board-connecting connector 1. Further, when the inner housings 3 and the outer housing 6 are locked together, the circuit board 2 is correctly connected to the board-connecting connector 1.

Only when pushing the locking arm 18, the lock between the inner housings 3 and the outer housing 6 is easily released. Then, when pulling out the circuit board 2, the upper and lower inner housings 3 are pulled out of the outer housing 6 and separated up and down along the guiding holes 13, 14. Thus, the lock between the circuit board 2 and the board-connecting connector 1 is also easily released. A structure shown in FIGS. 16 to 18 works to resolve the problems of the conventional embodiment shown in FIGS. 22 and 23.

Figure 19:
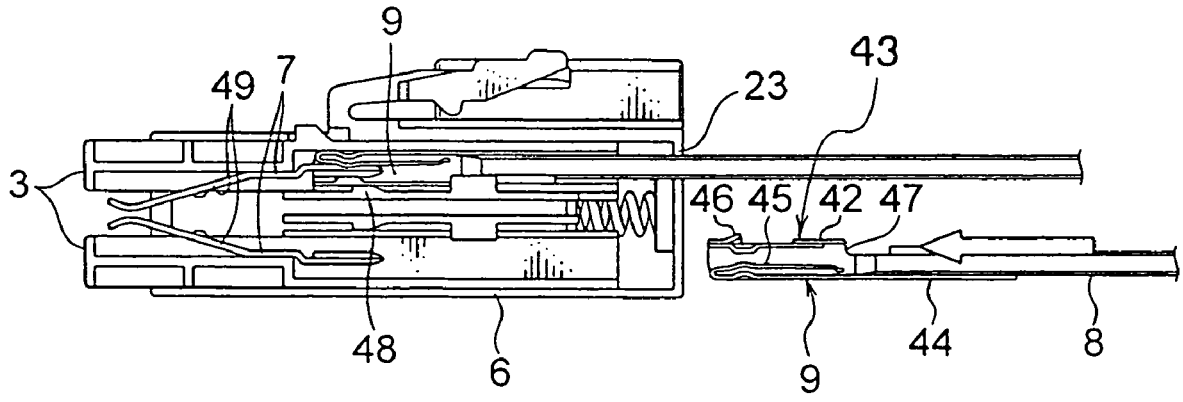
FIG. 19 is a vertical sectional view showing a state that a terminal having an electric wire is inserted while the inner housing is inserted into the outer housing.

FIG. 19 shows a state that while the elastic contact terminals 7 are attached to the inner housings 3, and the inner housings 3 with the guising plates 4 are half-inserted into the outer housing 6 (as shown in FIG. 3), the female terminal 9 with the electric wire 8 is inserted into between the inner housings 3 via a rear opening 23 of the outer housing 6 to make the female terminal abut on the elastic contact terminals 7.

The female terminal 9 may be an existing female terminal. The female terminal 9 having the electric wire 8 is inserted into a sub-connector assembly composed of the inner housings 3, the elastic contact terminal 7, the guising plates 4, and the outer housing 6 in an existing wiring harness production process. Thus, the board-connecting connector 1 is assembled with a low cost without changing the wiring harness production process.

The female terminal 9 is composed of a rectangular tubular elastic contact part 43 and electric wire connecting part 44. The elastic contact part 43 includes an elastic contact piece 45 disposed in a rectangular tubular wall, a locking piece 46 projected from the rectangular tubular wall, and a locking step 47 disposed at a rear end of the rectangular tubular wall. The electric wire connecting part 44 may be a crimping piece or a pressure welding piece.

An upper female terminal 9 in FIG. 19 is firstly connected to the rear end of the elastic contact terminal 7. The locking piece 46 is engaged with a projection of a locking lance 48 of the inner housing 3 to be firstly locked. The locking step 47 of the upper female terminal 9 is secondary locked on a side spacer (not shown) made of synthetic resin with the lower female terminal 9. The upper and lower female terminals 9 are disposed symmetrically back to back, and the upper and lower elastic contact pieces 45 are disposed symmetrically front to front.

In FIG. 19, while the inner housings 3 are half-inserted, the female terminal 9 is inserted from the rear side. However, the female terminal 9 may be inserted to contact the elastic contact terminal 7 while the inner housings 3 is fully inserted as shown in FIGS. 6 and 7.

Figure 20A:
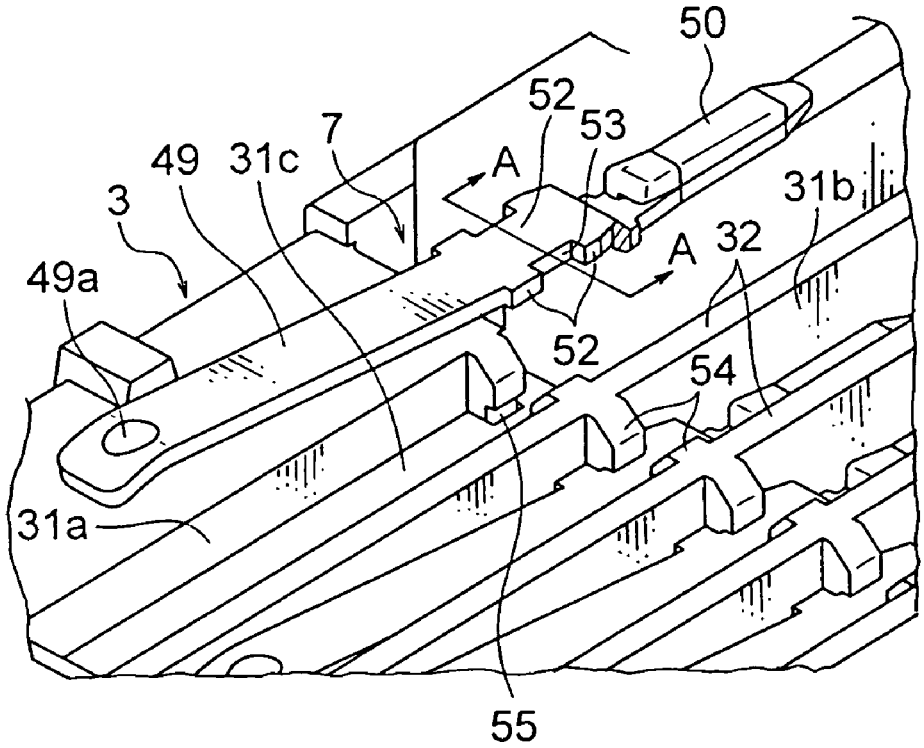
FIG. 20A is an exploded perspective view showing a state that an elastic contact terminal is attached to an interior of the inner housing.

FIG. 20A shows the elastic contact terminal 7 disposed in the inner housing 3. The elastic contact terminal 7 is formed in a long plate shape, and includes a front sloped elastic contact piece 49, a rear horizontal terminal connecting tab 50, and a mid horizontal fixing part 51. The elastic contact terminal 7 connects the circuit board 2 to the female terminal 9 having the electric wire 8.

As shown in FIG. 19, the elastic contact piece 49 of the lower elastic contact terminal 7 is sloped upward, and the elastic contact piece 49 of the upper elastic contact terminal 7 is sloped downward. Each elastic contact piece 49 includes a contact projection 49*a* with respect to the terminal part 11 of the circuit board 2 (FIG. 14) at an inner front end thereof. The terminal connecting tab 50 is a horizontal straight male terminal and is inserted into a rectangular tubular wall 43 of the female terminal 9 (FIG. 19) to contact the elastic contact piece 45. The mid fixing part 51 includes a pair of projections at both sides and a rectangular groove 53 interposed between the projections.

A straight terminal receiving groove 31 is horizontally formed on the inner housings 3. The terminal receiving groove 31 includes a groove part 31*a* for receiving the elastic contact piece 49 and a groove part 31*b* for receiving the terminal connecting tab 50. Each terminal receiving groove 31 are partitioned by the partition wall 32. A pair of left and right projecting walls 54 is formed on inner walls of the partition walls 32 in between the front and back groove parts 31*a*, 31*b*. A horizontal groove 55 is formed on the projecting wall 54 in between the projecting wall 54 and a bottom groove 31*c*.

Figure 20B:
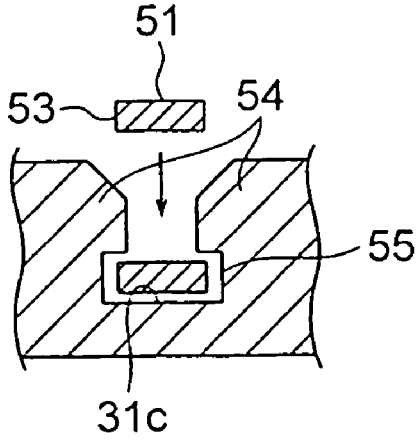
FIG. 20B is a sectional view taken on line A-A of FIG. 20A.

As shown in FIG. 20B, the groove part (narrow width part) 53 of the fixing part 51 of the elastic contact terminal 7 is pushed into between the pair of projecting walls 54, and engaged with the groove 55 of the projecting wall 54 to prevent the elastic contact terminal 7 from moving in a longitudinal direction thereof. Then, the female terminal 9 is inserted into the inner housings 3, and the terminal connecting tab 50 is inserted into the female terminal 9. The structure shown in FIG. 19 works as an assembling method of the board-connecting connector 1.

Incidentally, in this embodiment, the circuit board 2 is different from the board-connecting connector 1. However, the board-connecting connector 1 may include the circuit board 2.

Further, in this embodiment, the female terminal 9 is used. However, without using the female terminal 9, the electric wire 8 may be directly connected to the elastic contact terminal 7 by crimping, pressure welding or the like. Further, in this embodiment, the male type terminal connecting tab 50 is formed on the elastic contact terminal 7. However, a female type terminal connecting part (not shown) may be formed instead of the terminal connecting tab 50, and a male type terminal (not shown) having the electric wire 8 may be inserted into the female type terminal connecting part. Further, a bus bar or the like (not shown) may be used instead of the electric wire 8, and the bus bar may be connected to the elastic contact terminal 7.

Further, in this embodiment, only the lower inner housing 3 is moved upward along the sloped guiding hole 14. However, the upper inner housing 3 may be moved downward along a sloped guiding hole 13. In this case, the locking projection 16 is formed longer to compensate. Alternatively, a side wall is locked on the locking arm 18 of the outer housing 6 instead of the upper inner housing.

Further, in this embodiment, through holes are used as the guiding hole 13, 14. However, the guiding holes may not be though holes. Further, in this embodiment, the coil spring 5 is used as the elastic member. However, plate spring, or elastomer material may be used instead of the coil spring 5.

Further, the coil spring 5 may not be used. For example, after the sliding guising plates 4 are inserted into guiding grooves (not shown) of the side wall 57 (FIG. 13) of the outer housing 6, rear ends of the guising plates 4 may abut on rear ends of the guiding grooves, so that the guiding grooves hold the guising plates 4.

Further, in this embodiment, as locking members for locking the inner housings 3 and the circuit board 2, the projections 21 are formed on the inner housings 3, and the grooves 20 are formed on the circuit board 2. However, the grooves 20 may be formed on the inner housings 3, and the projections 21 may be formed on the circuit board 2.

Further, in this embodiment, as locking members for locking the inner housings 3 and the guising plates 4, the locking projection 16 is formed on the inner housing 3, and the step wall (concave) 19 is formed on the locking arm 18 of the outer housing 6. However, a concave groove (not shown) may be formed on the inner housing 3, and a projection (not shown) may be formed on the locking arm 18.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A board-connecting connector comprising:

a pair of inner housings opposed to each other for receiving elastic contact terminals for holding a circuit board, each said inner housing having inner housing-driven projections extending laterally;

a pair of guiding plates arranged at lateral sides of said inner housings, each said guiding plate having a sloped guiding part including holes for engaging said inner housing-driven projections and guiding the inner housings close to each other; and an outer housing for receiving the inner housings and the guiding plates, and holding the guiding plates, wherein when the circuit board is fully inserted into the pair of inner housings, the circuit board abuts on the inner housings, and pushes to move the inner housings along the guiding plates.

2. The board-connecting connector as claimed in claim 1, wherein each said guiding plate also has a straight guiding part including holes, and wherein the inner housing-driven projection of one inner housing is engaged with the straight guiding part of the guiding plates in the insertion direction of the circuit board, and the inner housing-driven projection of the other inner housing is engaged with the sloped guiding part of each of the guiding plates.

3. The board-connecting connector as claimed in claim 1, further comprising elastic members for pushing the guiding plates in a direction opposed to the insertion direction of the circuit board in the outer housing.

4. The board-connecting connector as claimed in claim 3, wherein the elastic members absorb variation in the thickness of the circuit board.

5. The board-connecting connector as claimed in claim 1, wherein as the pair of inner housings is close to each other in the thickness direction of the circuit board, the pair of inner housings are positioned by an engagement between a convex part and a concave part thereof.

6. The board-connecting connector as claimed in claim 1, wherein as the circuit board and at least one of the inner housings are moved close to each other in the thickness direction of the circuit board, the circuit board and at least one of the inner housings are locked together with an engagement of a convex part and a concave part thereof.

7. The board-connecting connector as claimed in claim 1, wherein the inner housing and a locking arm of the outer housing are locked together with an engagement of a convex part and a concave part thereof.

8. The board-connecting connector as claimed in claim 1, wherein while the pair of inner housings is inserted into the outer housing, a terminal is inserted from a position opposed to the circuit board and is connected to the elastic contact terminal.

9. A board-connecting connector, comprising:

a pair of inner housings opposed to each other for receiving elastic contact terminals for holding a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate, and wherein the inner housing-driven projection of one inner housing is engaged with a straight guiding part of the guiding plate in the insertion direction of the circuit board, and the inner housing-driven projection of the other inner housing is engaged with the sloped guiding part of the guiding plate.

10. A board-connecting connector, comprising:

a pair of inner housings opposed to each other for receiving elastic contact terminals for holding a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate, the board-connector further comprising an elastic member for pushing the guiding plate in a direction opposed to the insertion direction of the circuit board in the outer housing, wherein the elastic member absorbs variation in the thickness of the circuit board.

11. A board-connecting connector, comprising:

a pair of inner housings opposed to each other for receiving elastic contact terminals for holding a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate, and wherein as the pair of inner housings is close to each other in the thickness direction of the circuit board, the pair of inner housings are positioned by an engagement between a convex part and a concave part thereof.

12. A board-connecting connector, comprising:

a pair of inner housings opposed to each other for receiving elastic contact terminals for holding a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate, and wherein as the circuit board and at least one of the inner housings are moved close to each other in the thickness direction of the circuit board, the circuit board and at least one of the inner housings are locked together with an engagement of a convex part and a concave part thereof.

13. A board-connecting connector, comprising:

a pair of inner housings opposed to each other for receiving elastic contact terminals for holding a circuit board;

a guiding plate having a sloped guiding part for engaging inner housing-driven projections and guiding the inner housings close to each other; and an outer housing for receiving the inner housings and the guide plate, and holding the guide plate, wherein when the circuit board is fully inserted into the pair of inner housings, the circuit board abuts on the inner housings, and pushes to move the inner housings along the guiding plate, and wherein the inner housing and a locking arm of the outer housing are locked together with an engagement of a convex part and a concave part thereof.

* * * * *